US007091832B1

(12) United States Patent
Butterman et al.

(10) Patent No.: US 7,091,832 B1
(45) Date of Patent: Aug. 15, 2006

(54) ACOUSTIC DETECTION OF MACHINERY MALFUNCTION

(75) Inventors: Jay A. Butterman, Brooklyn, NY (US); James J. Kelly, Bellerose, NY (US)

(73) Assignee: Fonar, Inc., Melville, NY (US)

( * ) Notice: Subject to any disclaimer, the term of this patent is extended or adjusted under 35 U.S.C. 154(b) by 323 days.

(21) Appl. No.: 10/456,167

(22) Filed: Jun. 6, 2003

Related U.S. Application Data

(60) Provisional application No. 60/388,805, filed on Jun. 14, 2002.

(51) Int. Cl.
*G08B 3/00* (2006.01)

(52) U.S. Cl. ..... 340/384.72; 340/384.5; 340/540; 340/692; 324/225; 381/58; 700/94

(58) Field of Classification Search ..... 340/384.72, 340/384.1, 384.6, 505, 540, 541, 692, 384.5, 340/384.7; 381/94.5, 58, 59, 104; 700/94; 324/225

See application file for complete search history.

(56) References Cited

U.S. PATENT DOCUMENTS 5,164,840 A * 11/1992 Kawamura et al. ..... 386/107
5,550,925 A * 8/1996 Hori et al. ..... 381/98
6,718,217 B1 * 4/2004 Shinohara et al. ..... 700/94
6,940,986 B1 * 9/2005 Belenger et al. ..... 381/104

* cited by examiner

*Primary Examiner*—Davetta W. Goins
(74) *Attorney, Agent, or Firm*—IP Strategies

(57) ABSTRACT

A sound variation indication apparatus includes a comparison element, an interval checker, and an indication generator. The comparison element receives an audio signal and compares it to a check value to provide a status signal indicating a presence and absence of an expected sound input. The interval checker detects the status signal at predetermined intervals, to provide an interval output. The indication generator generates an indication if the interval output is an absence representation. A process of generating an indication on absence of a sound input includes providing an audio signal based on a sound input and comparing the audio signal to a check value, providing a status signal indicating a presence and absence of the sound input. A status signal value is determined at predetermined intervals, to provide an interval output. An indication is generated if the interval output is an absence representation.

82 Claims, 9 Drawing Sheets

ACOUSTIC DETECTION OF MACHINERY MALFUNCTION

CROSS-REFERENCE TO RELATED APPLICATION

This is related to U.S. Provisional Patent Application Ser. No. 60/388,805, which was filed on Jun. 14, 2002 now abandoned.

BACKGROUND OF THE INVENTION

Certain machinery components emit sounds when operating under normal conditions. These sounds can be considered to be annoying, but can be reassuring as a sign that the machinery component is operating normally. For example, personal computers are equipped with fans that keep the CPU cool during operation. Although computer fans have become more quiet, the blowing sound made by the fan, or the hum emitted by the fan motor, is usually discernible. The absence of this sound, or a change in its usual qualities, can be interpreted as a potential problem in the functioning of the computer.

Other types of machinery perform continuously over certain periods of time, and emit characteristic sounds the entire time of performance. If the machinery component normally emits a distinct sound at regular intervals, the sudden absence of this sound could be a sign that the machinery component is experiencing degradation in performance, or even failure. A person monitoring the function of the machinery component could recognize the absence of the sound and investigate the cause of the interruption. However, the person might be distracted and wouldn't necessarily notice the absence of the sound. Further, a change in pitch or frequency, indicating degradation, might not be easily recognized. Also, some machinery operates unattended for at least some periods of time, and therefore the absence of the sound would not be noticed.

For example, one type of magnet, used in NMR imaging systems and for other applications, is ouffitted with superconducting magnet coils. These coils must be kept below a particular temperature in order to function properly. For example, the magnet coils can be maintained within a selected operating temperature range by using liquid helium, which is kept cool by cryocoolers, typically one for each magnet coil. The compressor for the cryocoolers can be air cooled or water cooled. If the compressor is water cooled, and if access to the cooling water is accidentally cut off, such as if water access is turned off in the building or if water pressure drops due to an emergency, the cryocoolers can go into thermal shutdown. Even after the water is turned back on, the cryocoolers typically need to be manually restarted and do not turn themselves back on. Without the cryocoolers running, the magnet will not work properly.

A cryocooler makes a regular chirping sound under normal operating conditions. Under conditions that cause performance of the cryocooler to degrade or fail, this chirp can become less regular in its rate and pitch, can occur at less frequent intervals, or can even stop, depending on the particular malfunction. It would be advantageous to provide a process by which a change or absence of this chirp would be recognized, and an indication, such as an alarm, provided as notification of the change. It would also be advantageous to provide an apparatus that can perform such a process.

BRIEF SUMMARY OF THE INVENTION

The present invention makes use of a natural effect of some machinery components to serve as the basis for detecting whether the component has broken down, is on the verge of failure, or is otherwise malfunctioning. As used herein, the term "malfunction" will refer to any aberration in the normal operation of a machine component, covering the range from harmless irregularity to complete failure. The present invention includes a process for monitoring the sound made by machinery components to determine when a malfunction might have occurred. The present invention also includes an apparatus that produces an indication based on a change in the sound made by the machinery component under normal operating conditions.

According to a particular aspect of the present invention, a sound variation indication apparatus includes a comparison element, an interval checker, and an indication generator. The comparison element receives an audio signal, compares the audio signal to a check value, and provides a status signal based on an outcome of the comparison. The status signal indicates a presence and absence of the sound input as corresponding to the check value, respectively indicating a presence value and an absence value. The interval checker receives the status signal and determines a value of the status signal at predetermined intervals, to provide an interval output. The interval output is a presence representation if a presence value is determined during an interval and an absence representation if no presence value is determined during an interval. The indication generator receives the interval output and generates an indication if the interval output is an absence representation.

The sound variation indication apparatus can also include a sound transducer that provides the audio signal to the comparison element, based on a received sound input. The sound transducer can include a microphone that receives the sound input and provides the audio signal. As an alternative example, the sound transducer can include a microphone that receives the sound input and provides a corresponding electrical signal, and a conditioning element that receives the electrical signal and provides the audio signal. For example, the conditioning element can be an amplifier that amplifies the electrical signal to provide the audio signal, or a buffer that buffers the electrical signal to provide the audio signal. Other conditioning elements, such as filters, can be used, either alone or in combination with the exemplary conditioning elements or other conditioning elements.

The comparison element can be a comparator circuit, in which case the check value is a voltage level corresponding to a level of the audio signal for an expected received sound input. The status signal can be a binary signal indicating the presence and absence of the expected received sound input. The interval checker can in this case provide an interval output that is an absence representation if the status signal does not indicate the presence of the expected received sound input during the predetermined interval. The interval checker can be an electronic circuit that can be fabricated on an integrated circuit chip, such as a retriggerable monostable multivibrator. The voltage level of the check value can correspond to an amplitude of the expected received sound input, the status signal can be a pulse corresponding to occurrence of the received sound input, and the predetermined interval can be based on a rate of recurrence of the expected received sound input. For example, if the status signal is a periodic pulse corresponding to the expected received sound input, which is expected to be a periodic sound input, the predetermined interval can be based on a frequency of the expected periodic sound input.

The indication generated by the indication generator can be a state change, such as a hardware state change or a software state change. The sound variation indication apparatus can also include an alarm device that is actuated by the state change. Alternatively, the indication generator can be the alarm itself. The alarm device can be a sensory device, such as a buzzer, bell, strobe, LED, or vibrating mechanism; a non-sensory hardware device, such as a switch, a latch, or a local network pager transmitter; or a software device, such as a telephone dialing program, a network prompter for sending an automated e-mail message, or a program for making a log entry.

In an exemplary application, the sound transducer can be disposed near enough to a machine component such that when the machine component makes a repeated sound at regular intervals when functioning normally, the sound transducer receives the repeated sound as the received sound input. In such an exemplary application, the machine component can be, for example, a cryocooler.

Alternatively, the apparatus of the present invention can also include a machine component disposed near enough to the sound transducer such that when the machine component makes a repeated sound at regular intervals when functioning normally, the sound transducer receives the repeated sound as the received sound input. As in the example above, the machine component can be a cryocooler.

In order to improve the sound detection aspects of the present invention, the sound variation indication apparatus can also include acoustic insulation material disposed to at least partially isolate the sound transducer from ambient sound inputs to distinguish the received sound input. Alternatively, or in addition, the sound variation indication apparatus can also include an acoustic insulation structure, such as an isolation chamber, disposed to at least partially isolate the sound transducer from ambient sound inputs in order to distinguish the received sound input.

According to another aspect of the present invention, a sound variation indication apparatus can have an indication generator that shares a number of parallel monitoring circuits, each of which monitors the sounds made by different machinery components. Such an apparatus includes a plurality of comparison elements, a corresponding plurality of interval checkers, a summary status checker, and an indication generator. The plurality of comparison elements each receives an audio signal from a respective one of the plurality of sound transducers. Each of the plurality of comparison elements compares the received audio signal to a corresponding check value, and provides a respective status signal based on an outcome of the comparison. Each of the status signals indicates a presence and absence of the respective sound input as corresponding to the check value, respectively indicating a presence value and an absence value. The plurality of interval checkers each receive the respective status signal and determine a value of the status signal at predetermined intervals, to provide a respective interval output that is a presence representation if a presence value is determined during an interval and an absence representation if no presence value is determined during an interval. The summary status checker receives the interval outputs and provides a summary status that has a first value if a number of interval outputs that are presence representations is at least a predetermined number, and that has a second value if the number of interval outputs that are presence representations is less than the predetermined number. The indication generator receives the summary status and generates an indication if the summary status is the second value. The sound variation indication apparatus can also include a plurality of sound transducers that provide the respective plurality of audio signals based on respective received sound inputs.

Thus, a certain number of malfunctions detected by the plurality of monitor circuits will cause an indication to be generated. For example, the predetermined number can be the same as the total number of interval outputs, that is, even one detected malfunction will cause the indication to be generated. In this case, the summary status checker can be a logic circuit that performs an AND operation on the interval outputs. Alternatively, to allow the indication to be reset, the summary status checker can include a logic circuit that performs an AND operation on the interval outputs to provide a summary representation, and a re-settable register that receives the summary representation and provides the corresponding summary status. The re-settable register can be, for example, a flip-flop circuit. The summary status checker can also include a relay that actuates the indication generator if the summary status is the second value.

Alternatively stated, the summary status checker can include a logic circuit that performs an AND operation on the interval outputs to provide a summary representation, and a flip-flop circuit that receives the summary representation and processes the summary representation to provide the summary status. The flip-flop circuit can be re-settable. As in the previous case, the summary status checker can also include a relay that actuates the indication generator if the summary status is the second value.

According to another aspect of the present invention, a process of generating an indication on absence of a sound input includes providing an audio signal based on a received sound input and comparing the audio signal to a check value. A status signal is provided based on an outcome of the comparison. The status signal indicates a presence and absence of the sound input as corresponding to the check value, respectively indicating a presence value and an absence value. A value of the status signal is determined at predetermined intervals, to provide an interval output that is a presence representation if a presence value is determined during an interval and an absence representation if no presence value is determined during an interval. An indication is generated if the interval output is an absence representation.

The sound input can be received by and the audio signal can be provided by a microphone, which can be at least partially isolated from ambient sound inputs to distinguish the received sound input. For example, acoustic insulation material or an acoustic insulation structure can be disposed around at least a portion of the microphone. The process can also include disposing the microphone proximate to a machine component to receive the sound input. The machine component makes a repeated sound at regular intervals when functioning normally, and the microphone receives the repeated sound as the received sound input. The machine component can be, for example, a cryocooler.

Providing an audio signal based on a received sound input can include receiving the sound input, providing a corresponding electrical signal, and conditioning the electrical signal to provide the audio signal. Conditioning the electrical signal can include, for example, amplifying the electrical signal to provide the audio signal, buffering the electrical signal to provide the audio signal, filtering the electrical signal to provide the audio signal, or any combination of these or other conditioning actions.

Comparing the audio signal to a check value can include providing the audio signal to a comparator circuit, which compares the audio signal to a voltage level corresponding to a level of the audio signal for an expected received sound input. The status signal can be a binary signal indicating the presence and absence of the expected received sound input. In this case, determining a value of the status signal at predetermined intervals can include providing an interval output that is an absence representation if the status signal does not indicate the presence of the expected received sound input during the predetermined interval. Determining a value of the status signal at predetermined intervals can be performed, for example, by a retriggerable monostable multivibrator. The voltage level can correspond to an amplitude of the expected received sound input. The status signal can be a pulse corresponding to occurrence of the received sound input, and the predetermined interval is based on a rate of recurrence of the expected received sound input. For example if the status signal is a periodic pulse corresponding to the expected received sound input, which is an expected periodic sound input, the voltage level can correspond to an amplitude of the expected received sound input, and the predetermined interval can be based on a frequency of the expected periodic sound input.

Thus, a process is provided by which a change or absence of an expected sound is recognized, and an indication provided as notification of the change. An apparatus is also provided that can perform such a process. In application, for example, a chirp detector or a low sound level indicator can be added to a magnet system as an early detector of a malfunction in a cryocooler. These detectors can be disposed, for example, on the cryocooler's compressor cooling lines, and can be surrounded by foam as necessary.

The indication generated by the process of the present invention can be a state change, such as a hardware state change or a software state change. The state change can in turn actuate an alarm. Alternatively, the generated indication can be the alarm itself. The alarm can be a sensory alarm, such as a sound, light, or vibration; a non-sensory alarm, such as movement of a switch, a latch, or a local network pager transmitter; or a software alarm, such as a telephone dialing action, a network prompt for sending an automated e-mail message, or actuation of a program for making a log entry. Thus, the indication can be a change of state, which in turn can provide a local alarm by way of a sensory warning or a remote alarm by pager or telephone. Once the indication has been generated, log entries can be made, e-mail can be sent, and, if appropriate, devices such as switches and latches can be set, to activate emergency back-up systems or to turn off the main system if continued operation under malfunction conditions could lead to failure.

It will be apparent to those of skill in the art that the apparatus of the invention can be embodied in a number of different ways, including analog circuitry, digital logic circuitry, software systems, and firmware, or any combination of these. Likewise, it is contemplated that the process of the invention as described herein and recited in the claims can be performed by hardware, firmware, or software, or any combination of these or any other apparatus.

DETAILED DESCRIPTION OF THE INVENTION

Figure 1:
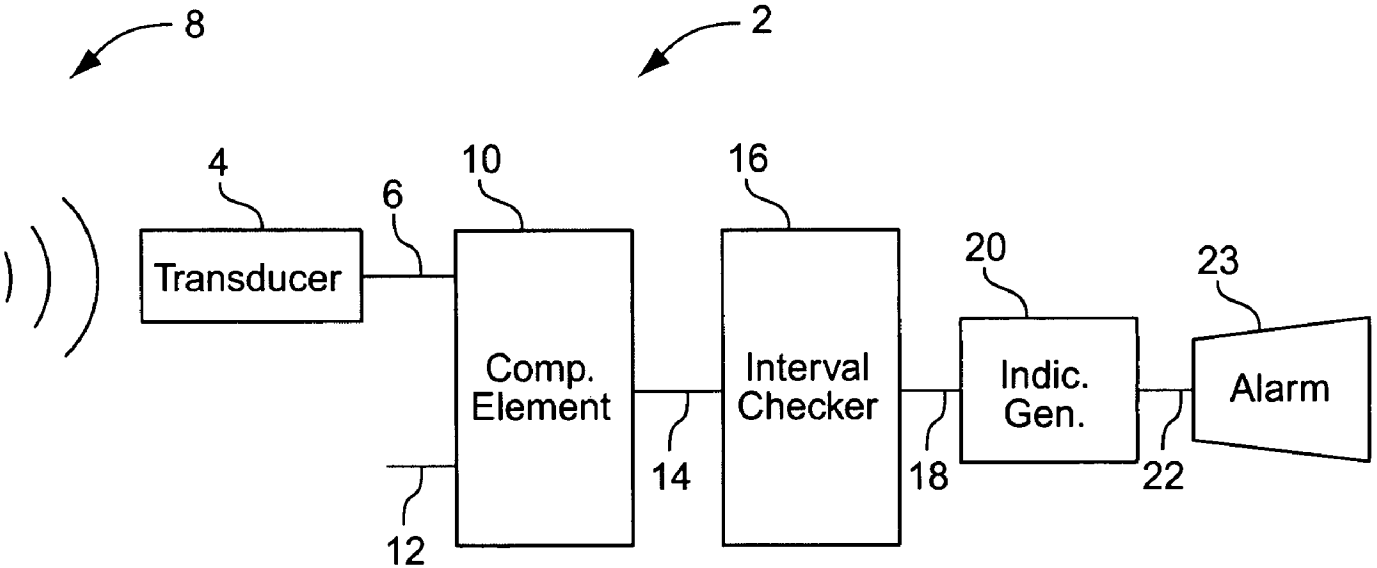
FIG. 1 is a block diagram of the sound variation indication apparatus of the present invention.

With reference to FIG. 1, an exemplary sound variation indication apparatus 2 according to the present invention is described. As shown, the sound variation indication apparatus 2 includes a sound transducer 4 that provides an audio signal 6 based on a received sound input 8. Alternative embodiments of the present invention include only a connector or port for receiving the audio signal 6 from a separate sound transducer 4 that can be connected to the sound variation indication apparatus. A comparison element 10 receives the audio signal 6, compares the audio signal 6 to a check value 12, and provides a status signal 14 based on an outcome of the comparison. The status signal 14 indicates a presence of the sound input 8 as a result of the comparison to the check value 12 by providing a presence value, and indicates an absence of the sound input 8 as a result of the comparison to the check value 12 by providing an absence value. For example, if digital logic circuitry is used, a low level or zero value for the status signal 14 can indicate an absence value, and a high level or one value for the status signal 14 can indicate a presence value.

An interval checker 16 receives the status signal 14 and determines a value of the status signal 14 at predetermined intervals. As a result of this determination, the interval checker 16 provides an interval output 18 that is a presence representation if a presence value is determined during an interval and an absence representation if no presence value is determined during an interval. That is, the interval checker 16 begins checking the status signal 14 at the beginning of each predetermined interval. If the status signal 14 indicates a presence value during that interval, the interval checker 16 provides an interval output 18 that is a presence representation. On the other hand, if the interval lapses and the status signal 14 did not indicate a presence value during that interval, the interval checker 16 provides an interval output 18 that is an absence representation.

An indication generator 20 receives the interval output 18 from the interval checker 16. As long as the interval output 18 is a presence representation, the indication generator 20 does not issue an indication 22 of a variation of the sound input. However, the indication generator 20 does generate an indication 22 if the interval output 18 is an absence representation. The indication 22 that is generated can be, for example, a state change, such as a hardware state change or a software state change, which can in turn be used to actuate an alarm 23 or other additional device or action based on the sound input variation indication. Alternatively, the indication 22 can be the alarm itself. As previously described, an alarm device according to the present invention can be a sensory device, such as a buzzer, bell, strobe, LED, or vibrating mechanism; a non-sensory hardware device, such as a switch, a latch, or a local network pager transmitter; or a software device, such as a telephone dialing program, a network prompter for sending an automated e-mail message, or a program for making a log entry. Thus, the indication generator initiates a change of state, which in turn can provide a local alarm by way of a sensory warning or a remote alarm by pager or telephone. Once the indication has been generated, log entries can be made, e-mail can be sent, and, if appropriate, devices such as switches and latches can be set, to activate emergency back-up systems or to turn off the main system if continued operation under malfunction conditions could lead to failure.

Figure 2A:
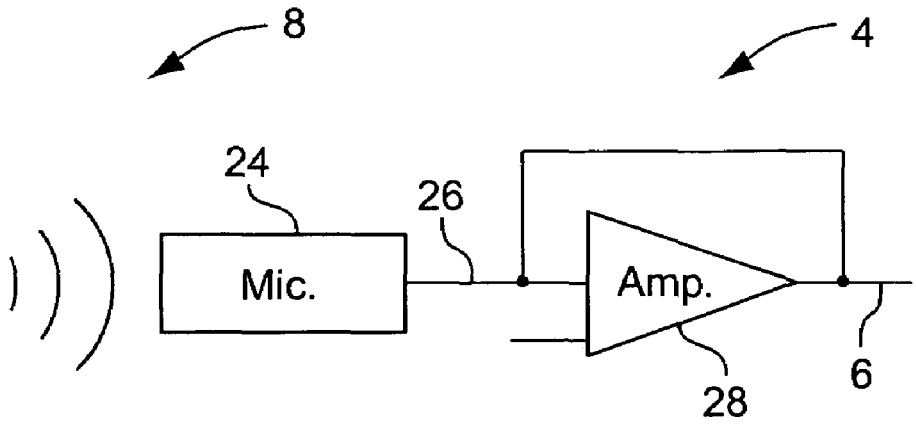
FIG. 2A and FIG. 2B are block diagrams of particular embodiments of the sound transducer of the sound variation indication apparatus of the present invention.
Figure 2B:
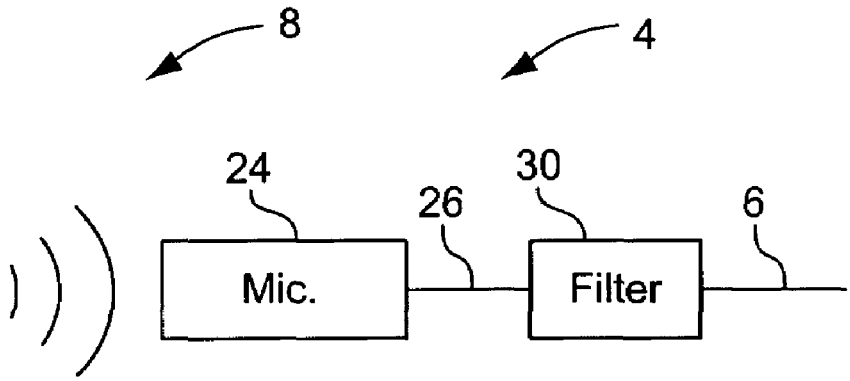

According to particular embodiments of the present invention, the sound transducer 4 can include a microphone that receives the sound input 8 and provides the audio signal 6. As shown in FIGS. 2A and 2B, in addition to the microphone 24, which receives the sound input 8 and provides a corresponding electrical signal 26, the sound transducer can include a conditioning element that receives the electrical signal 26 and provides the audio signal 6. For example, the conditioning element shown in FIG. 2A is an amplifier 28, which amplifies the electrical signal 26 to provide the audio signal 6. The conditioning element shown in FIG. 2B is a filter 30 that filters the electrical signal 26 to provide the audio signal 6, to reduce ambient sound from the received sound input or to distinguish the target sound input from another sound input that is expected to occur. It is contemplated that the amplifier 28 and filter 30 can be used together, or that other conditioning elements can be used as an alternative to or with these devices. For example, the electrical signal can also be buffered.

Figure 9:
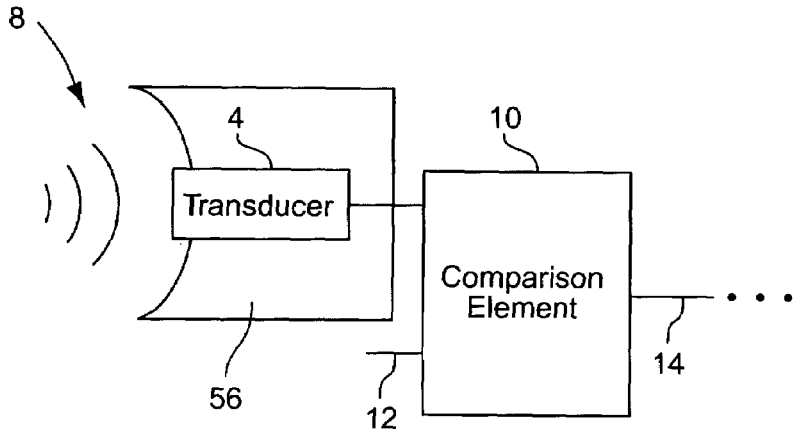
FIG. 9 is a block diagram of acoustic isolation for the sound transducer according to the present invention.

As shown in FIG. 9, the sound transducer 4 can be at least partially isolated from ambient sound such as other machinery sound, in order to make the intended sound input more distinct, so that the sound variation indication will be more reliable. Acoustic insulation material or an acoustic insulation structure 56, such as an acoustic isolation chamber, can be disposed around at least a portion of the sound transducer 4. This will reduce the amount of ambient sound that will be picked up by the sound transducer 4. The material or structure 56 can be shaped so as to provide better insulation properties, and to better isolate the intended sound input 8.

The comparison element 10 can be embodied as a typical comparator circuit, such as that provided on a comparator IC. The check value 12 provided to the comparison element 10 is a voltage level to which the audio signal 6 is compared, corresponding to a level of the audio signal 6 for an expected received sound input 8. Thus, the expected sound input 8 provides a particular audio signal 6 according to the design of the sound transducer 4. The voltage level that serves as the check value 12 is set to the expected audio signal 6 level, so that a favorable comparison results in a status signal 14 that is a presence representation each time an expected sound input 8 is received. Thus, if digital circuitry is used, the status signal 14 can be a binary signal indicating the presence or absence of the expected received sound input.

Because the received sound input 8 is expected to be intermittently repeated according to a noted interval, the status signal 14 will likewise alternately indicate the presence and absence of the sound input 8. Because the indication should not be generated during times between issuance of the intermittent sound input 8, the interval checker 16 ensures that the indication stays off as long as the sound input 8 is received once during each interval. Thus, the interval checker 16 checks the status signal 14 over the course of each interval, and provides an interval output 18 that is an absence representation only if the status signal 14 does not indicate the presence of the expected received sound input 8 during the predetermined interval. If the status signal indicates the presence of the expected received sound input 8 at all during the predetermined interval, the interval output 18 will be a presence representation. As will be shown later, a retriggerable monostable multivibrator or similar circuit can be used as the interval checker 16.

Figure 3:
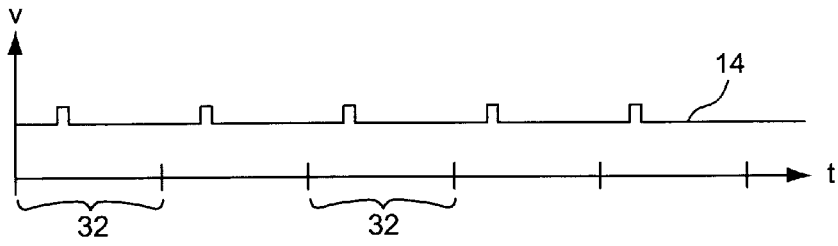
FIG. 3 is a timing diagram showing the status signal pulses and measured intervals of a particular embodiment of the sound variation indication apparatus of the present invention.

Thus, as shown in FIG. 3, in particular embodiments of the present invention the voltage level of the check value 12 corresponds to the amplitude of the expected received sound input 8, the status signal 14 is a pulse train corresponding to occurrence of the received sound input 8, and the predetermined interval 32 is based on a rate of recurrence of the expected received sound input 8. Thus, if the received sound becomes reduced in magnitude, so that it is no longer as loud as it is expected, it will no longer compare positively against the check value 12, and the status signal 14 will indicate an absence. If a particular pitch is expected for the expected received sound input 8, the filter 30 used as the conditioning element can be a bandpass filter that is designed to pass the particular frequency of the expected sound input 8. If the pitch of the received sound input changes, which could be a sign of malfunction, the filter will not pass the received sound input, the status signal will indicate an absence value throughout the interval 32, and an indication 22 will be generated.

If it is expected that the sound input 8 is substantially periodic, and not just occurring at uncertain times within a time interval, the voltage level of the check value 12 corresponds to the amplitude of the expected received sound input 8, the status signal 14 is a periodic pulse corresponding to the expected received sound input 8, and the predetermined interval is based on a frequency of the expected periodic sound input 8. The interval checker 16 in this case can be made to check the status signal 14 more precisely, that is, to determine the state of the status signal 14 at periodic instances rather than at any time during a prescribed interval. This is important if a change in the periodic nature of the expected sound input 8 is considered a sign of malfunction.

Figure 4:
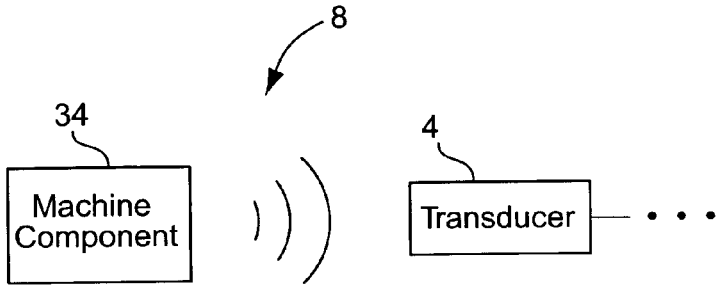
FIG. 4 is a block diagram of the sound variation indication apparatus of the present invention, showing a machine component proximate to the sound transducer.

As shown in FIG. 4, the sound transducer 4 is preferably disposed proximate to a machine component 34 that makes a repeated sound at regular intervals when functioning normally. The sound transducer 4 receives this repeated sound as the received sound input 8. For example, this machine component 34 can be a cryocooler, which emits "chirps" at substantially regular intervals under normal operating conditions.

Figure 5:
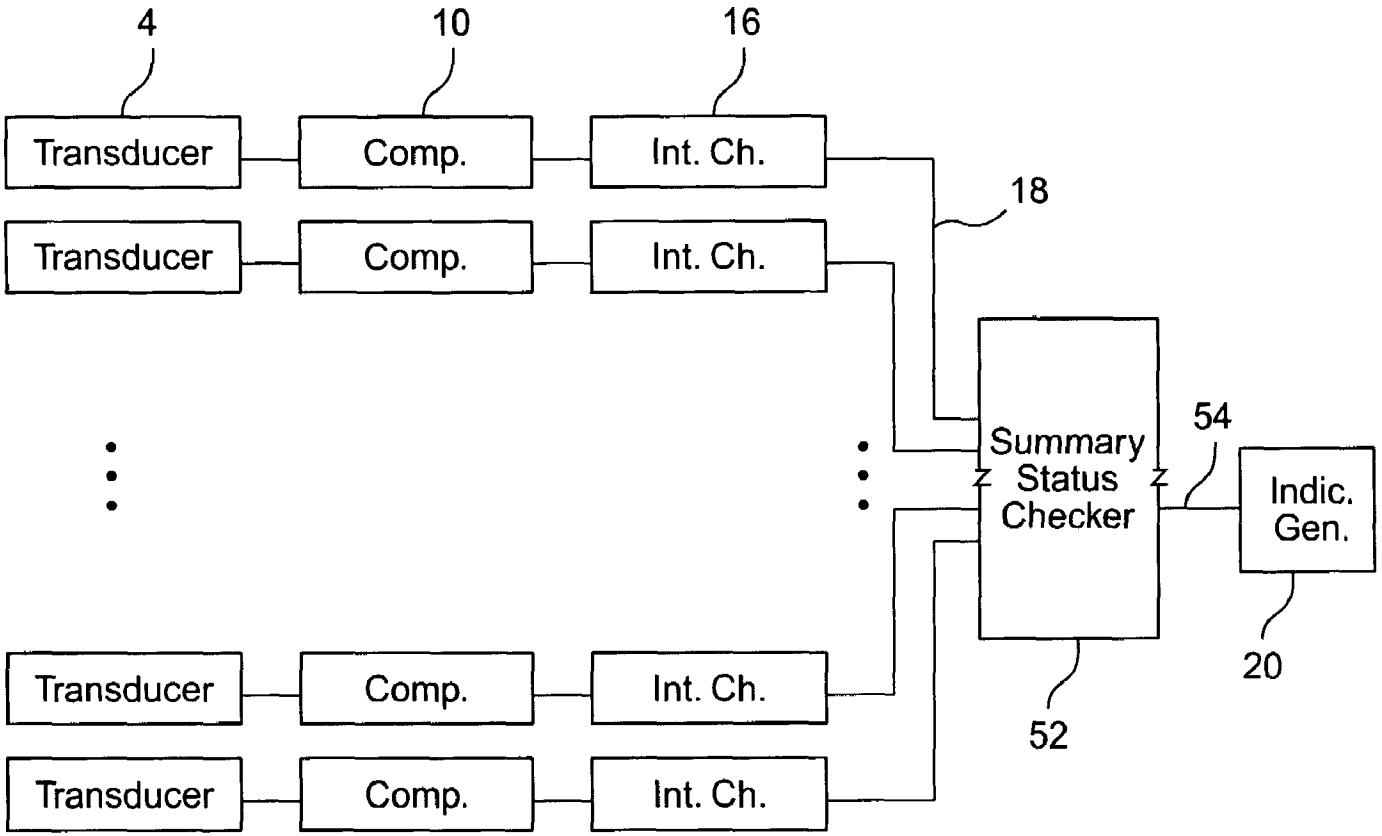
FIG. 5 is a block diagram of an embodiment of the sound variation indication apparatus of the present invention having a number of different monitoring circuits.

The exemplary embodiments described above can be modified to monitor more than one machine component simultaneously. According to another exemplary embodiment, a number of sound transducers 4 can provide a respective number of audio signals 6 based on respective received sound inputs, as shown in FIG. 5. Also as shown, a number of comparison elements 10 each receive the audio signal 6 from a respective one of the number of sound transducers 4. Each of the number of comparison elements 10 shown compares the received audio signal 6 to a corresponding check value 12, and provides a respective status signal 14 based on an outcome of the comparison. Each of the status signals 14 indicates whether the respective sound input is present or absent. A number of interval checkers 16 each receives the respective status signal 14 and determines a value of the status signal 14 during predetermined intervals. Each interval checker provides a respective interval output 18 that is a presence representation if a presence value is determined during an interval and an absence representation if no presence value is determined during an interval.

Figure 6:
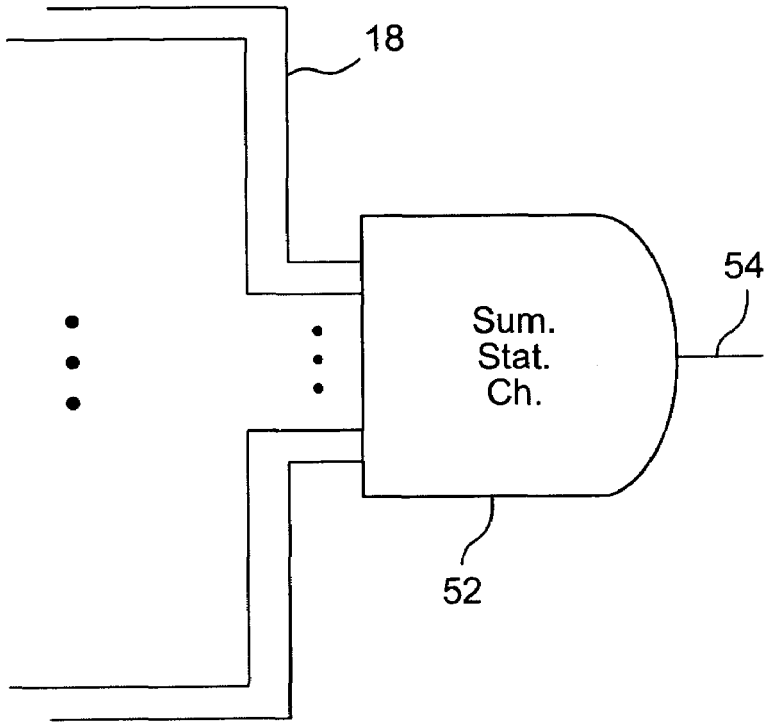
FIG. 6 is a schematic diagram of an AND gate that can be used as an exemplary summary status checker for the embodiment shown in FIG. 5.

As shown, a summary status checker 52 receives the interval outputs 18 and provides a summary status 54. The summary status 54 has a first value if a number of interval outputs that are presence representations is at least a predetermined number, and has a second value if the number of interval outputs that are presence representations is less than the predetermined number. The indication generator 20 receives the summary status 54 and generates an indication if the summary status 54 is the second value. Thus, if a predetermined number of sound inputs are absent during any interval, the indication will be generated. It is apparent to those of skill in the art that a combination of simple logic gates can be designed to provide predetermined summary status outputs according to any combination of inputs, giving all inputs equal weight or establishing priority for certain inputs over others. If an indication is to be generated if even one sound input is missing for an interval, the predetermined number is the same as the total number of interval outputs 18, that is, all the interval outputs 18 must be presence representations to avoid indicating a malfunction. In this case, the summary status checker 52 can be a logic circuit that performs an AND operation on the interval outputs, as shown in FIG. 6. Further, the summary status checker 52 can include a re-settable register that receives a summary representation from the AND circuit and provides the corresponding summary status 54. This register, which can be, for example, a flip-flop circuit, allows for manual resetting of the indication. The indication generator can be actuated by a relay that switches on receiving the second value as the summary status.

Figure 7:
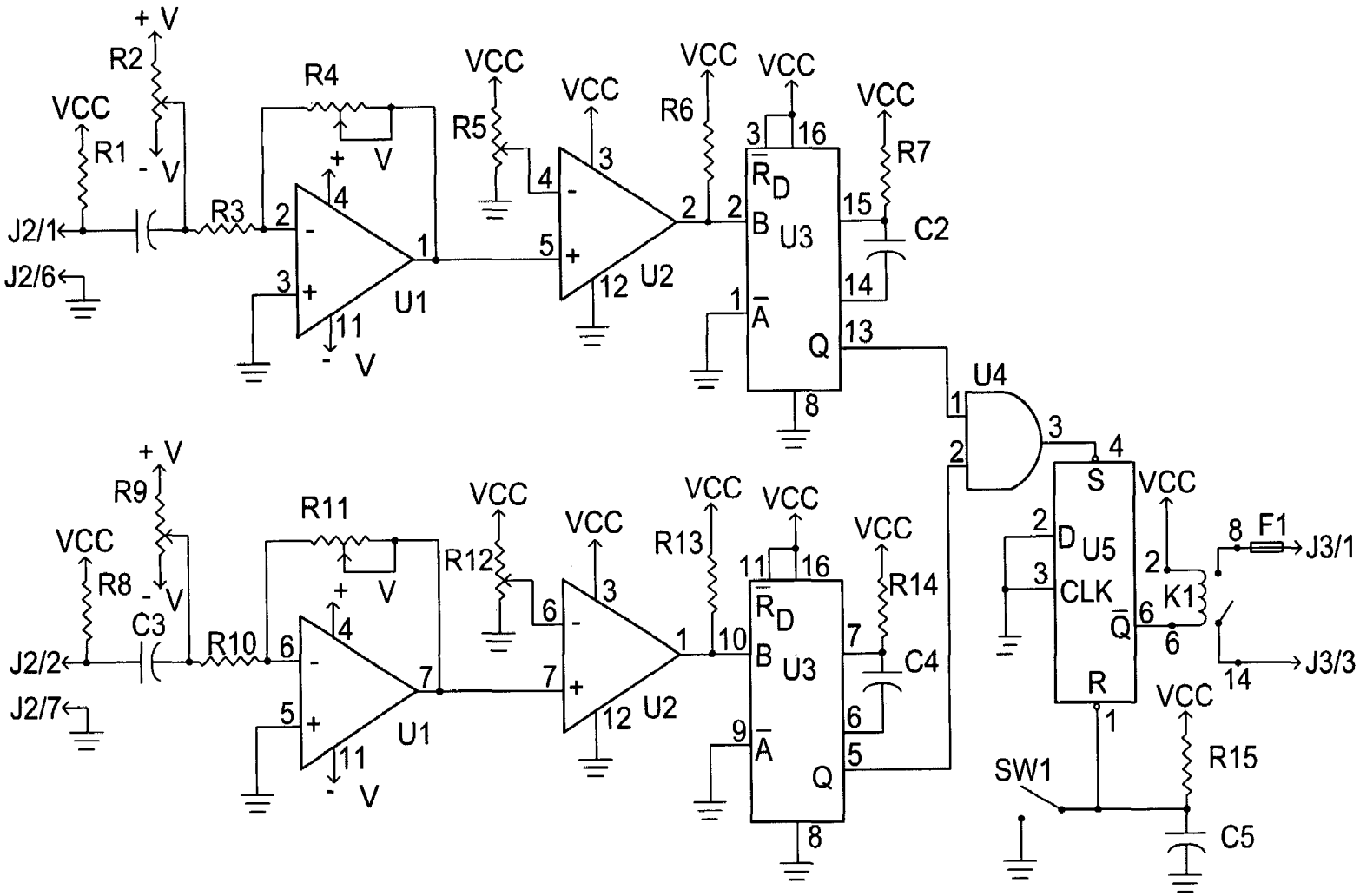
FIG. 7 is a schematic diagram of an exemplary embodiment of the sound variation indication apparatus shown in FIG. 5, having two monitoring circuits.

With reference to FIG. 7, the following is a description of a particular design of an exemplary circuit to be used to detect and indicate a malfunction mode of two machine components. The particular components and component values shown in this example are called out to demonstrate practical enablement, but equivalent components can be used within the scope of the present invention, and are contemplated by the inventors as viable alternatives.

As shown, an audio signal, provided by an external microphone coupled across connectors J2/1 and J2/6, is amplified by an operational amplifier U1. The offset and gain of the operational amplifier U1 can be adjusted through the use of, for example, the potentiometers R2 and R4. The output signal U1/1 from the operational amplifier U1 is provided to the non-inverted input U2/5 of the comparator U2. When this signal exceeds a pre-set voltage level, the comparator U2 generates a positive TTL-level pulse at U2/2. This pre-set voltage level can be adjusted using the potentiometer R5 connected to the U2/4 input of the comparator U2.

The output U2/2 of the comparator U2 is provided to the "B" input U3/2 of a retriggerable monostable multivibrator U3. If this multivibrator input U3/2 is not pulsed after a certain period of time, for example, 30 seconds, the multivibrator "Q" output U3/13, which is otherwise a TTL-level high output, will switch to a TTL-level low output. The multivibrator output U3/13 is provided to the input U4/1 of an AND gate U4. The input signal to the other AND gate input U4/2 is provided by a circuit that is identical to that described above, as shown. Thus, if either (or both) AND gate input receives a TLL-level low, the AND gate output U4/3 will also be set to a TTL-level low; the output U4/3 is set at a TTL-level high as long as both inputs are also set at TTL-level highs.

The output U4/3 of the AND gate U4 is provided to the "set" input U5/4 of a D-type flip-flop circuit U5. When the "set" input is a TTL-level low, the inverted "Q" output U5/6 of the flip-flop circuit U5 will change state. That is, if the flip-flop output U5/6 is set to a high level under normal operating conditions, a low level at the "set" input U5/4 will cause the flip-flop output U5/6 to go low. The presence of a low signal at the flip-flop output U5/6 can be used to actuate an alarm, for example, through a relay K1. The relay K1 is just one example of a circuit component that can undergo a state change on actuation by the flip-flop circuit U5, serving as an initial indication of a variation in the sound input. The alarm can be any type of alarm device coupled across connectors J3/1 and J3/3, for example, a sensory alarm such as a buzzer or blinking LED, a telephone dialer, a paging transmitter, or a network prompter, and serves as a further indication of the sound input variation. The alarm can be protected by a fuse F1. The relay K1 and alarm can be reset by providing a low level signal at the "reset" input U5/1 of the flip-flop circuit U5, for example, by connecting it to ground momentarily through the use of a momentary switch SW1.

Thus, the exemplary circuit design monitors intermittent sound at two machine components, for example, periodic chirping at two cryocoolers. If either or both of the cryocoolers fail, the indication will be generated. Microphones can be placed in advantageous locations at the cryocoolers to detect the chirping and convert the sound to audio signals that can be processed by the circuit. It should be noted that, although the circuit has been provided to monitor two audio signals simultaneously, two audio inputs are not necessary. If only a single input is to be monitored, one input of the AND gate can be fixed at a high level through the use of, for example, a pull-up arrangement. Likewise, more than two audio inputs can be monitored by using multiple operational amplifier/comparator/multivibrator circuits, and multiple logic gates in place of the disclosed single AND gate, as will be apparent to those of ordinary skill in the art.

Figure 8:
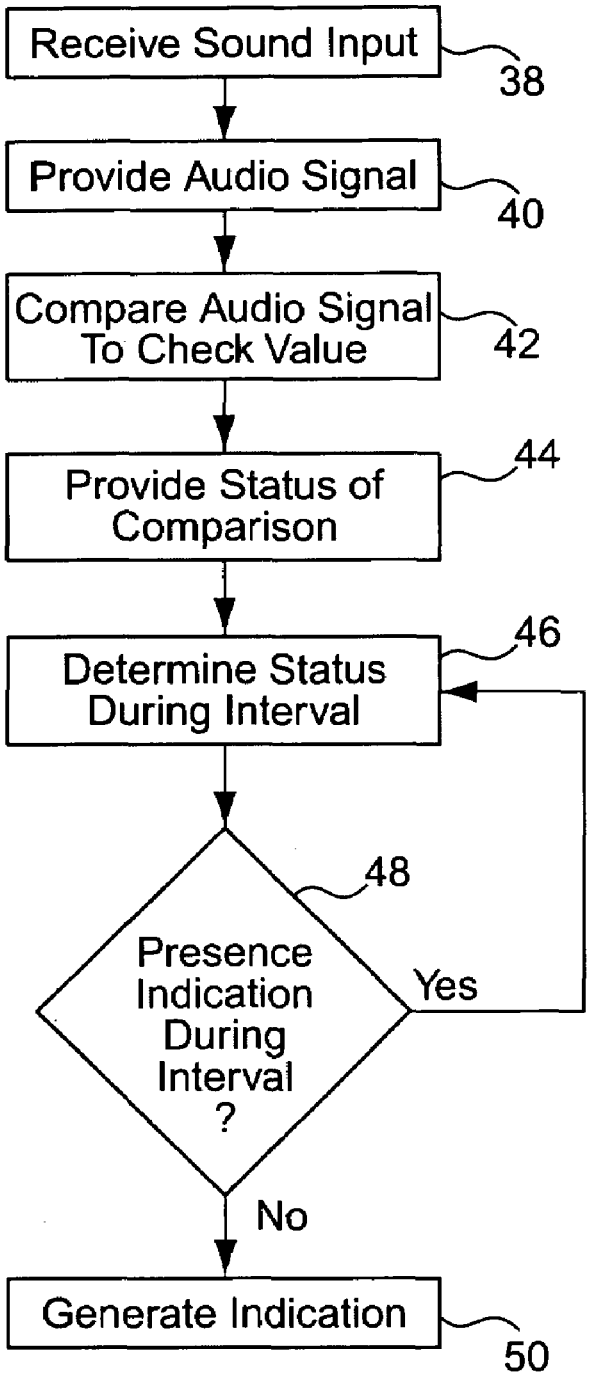
FIG. 8 is a flow diagram illustrating an exemplary process according to the present invention.

As shown in FIG. 8, an exemplary process of generating an indication on absence of a sound input according to the present invention includes receiving a sound input 38 and providing an audio signal 40 based on the sound input. The audio signal is compared to a check value 42, and a status signal is provided based on an outcome of the comparison 44. The value of the status signal is determined during predetermined intervals 46, to provide an interval output that is a presence representation if a presence value is determined during an interval and an absence representation if no presence value is determined during an interval. If the presence representation is not made during an interval, an indication is generated 50. If the presence representation is made during the interval, the status determination continues for the next interval 46. Many devices and circuit designs can be used to implement the process of the present invention, including the exemplary designs described above.

What is claimed is:

1. Sound variation indication apparatus, comprising:

a comparison element that receives an audio signal, compares the audio signal to a check value, and provides a status signal based on an outcome of the comparison, wherein the status signal indicates a presence and absence of the sound input as corresponding to the check value, respectively indicating a presence value and an absence value;

an interval checker that receives the status signal and determines a value of the status signal at predetermined intervals, to provide an interval output that is a presence representation if a presence value is determined during an interval and an absence representation if no presence value is determined during an interval; and an indication generator that receives the interval output and generates an indication if the interval output is an absence representation.

2. The sound variation indication apparatus of claim 1, further comprising a sound transducer that provides the audio signal to the comparison element, based on a received sound input.

3. The sound variation indication apparatus of claim 2, wherein the sound transducer includes a microphone that receives the sound input and provides the audio signal.

4. The sound variation indication apparatus of claim 2, wherein the sound transducer includes a microphone that receives the sound input and provides a corresponding electrical signal; and a conditioning element that receives the electrical signal and provides the audio signal.

5. The sound variation indication apparatus of claim 4, wherein the conditioning element is an amplifier that amplifies the electrical signal to provide the audio signal.

6. The sound variation indication apparatus of claim 4, wherein the conditioning element is a buffer that buffers the electrical signal to provide the audio signal.

7. The sound variation indication apparatus of claim 4, wherein the conditioning element is a filter that filters the electrical signal to provide the audio signal.

8. The sound variation indication apparatus of claim 1, wherein the comparison element is a comparator circuit and the check value is a voltage level corresponding to a level of the audio signal for an expected received sound input.

9. The sound variation indication apparatus of claim 8, wherein the status signal is a binary signal indicating the presence and absence of the expected received sound input.

10. The sound variation indication apparatus of claim 9, wherein the interval checker provides an interval output that is an absence representation if the status signal does not indicate the presence of the expected received sound input during the predetermined interval.

11. The sound variation indication apparatus of claim 10, wherein the interval checker is a retriggerable monostable multivibrator.

12. The sound variation indication apparatus of claim 10, wherein the voltage level of the check value corresponds to an amplitude of the expected received sound input.

13. The sound variation indication apparatus of claim 12, wherein the status signal is a pulse corresponding to occurrence of the received sound input.

14. The sound variation indication apparatus of claim 13, wherein the predetermined interval is based on a rate of recurrence of the expected received sound input.

15. The sound variation indication apparatus of claim 12, wherein the status signal is a periodic pulse corresponding to the expected received sound input.

16. The sound variation indication apparatus of claim 15, wherein the expected received sound input is an expected periodic sound input.

17. The sound variation indication apparatus of claim 15, wherein the predetermined interval is based on a frequency of the expected periodic sound input.

18. The sound variation indication apparatus of claim 1, wherein the indication generator generates the indication in the form of a state change.

19. The sound variation indication apparatus of claim 18, wherein the state change is a hardware state change.

20. The sound variation indication apparatus of claim 18, wherein the state change is a software state change.

21. The sound variation indication apparatus of claim 18, further including an alarm device that is actuated by the state change.

22. The sound variation indication apparatus of claim 21, wherein the alarm device is a sensory device.

23. The sound variation indication apparatus of claim 21, wherein the alarm device is a non-sensory hardware device.

24. The sound variation indication apparatus of claim 21, wherein the alarm device is a software device.

25. The sound variation indication apparatus of claim 1, wherein the indication generator is an alarm device.

26. The sound variation indication apparatus of claim 25, wherein the alarm device is a sensory device.

27. The sound variation indication apparatus of claim 25, wherein the alarm device is a non-sensory hardware device.

28. The sound variation indication apparatus of claim 25, wherein the alarm device is a software device.

29. The sound variation indication apparatus of claim 2, wherein the sound transducer is disposed proximate to a machine component that makes a repeated sound at regular intervals when functioning normally, and the sound transducer receives the repeated sound as the received sound input.

30. The sound variation indication apparatus of claim 29, wherein the machine component is a cryocooler.

31. The sound variation indication apparatus of claim 29, further including a machine component disposed proximate to the sound transducer, wherein the machine component makes a repeated sound at regular intervals when functioning normally, and the sound transducer receives the repeated sound as the received sound input.

32. The sound variation indication apparatus of claim 31, wherein the machine component is a cryocooler.

33. The sound variation indication apparatus of claim 2, further including acoustic insulation material disposed to at least partially isolate the sound transducer from ambient sound inputs to distinguish the received sound input.

34. The sound variation indication apparatus of claim 2, further including an acoustic insulation structure disposed to at least partially isolate the sound transducer from ambient sound inputs to distinguish the received sound input.

35. Sound variation indication apparatus, comprising:

a plurality of comparison elements that each receives one of a plurality of audio signals from a respective one of the plurality of sound transducers, wherein each of the plurality of comparison elements compares the received audio signal to a corresponding check value, and provides a respective status signal based on an outcome of the comparison, wherein each said status signal indicates a presence and absence of the respective sound input as corresponding to the check value, respectively indicating a presence value and an absence value;

a plurality of interval checkers that each receives the respective status signal and determines a value of the status signal at predetermined intervals, to provide a respective interval output that is a presence representation if a presence value is determined during an interval and an absence representation if no presence value is determined during an interval;

a summary status checker that receives the interval outputs and provides a summary status that has a first value if a number of interval outputs that are presence representations is at least a predetermined number, and that has a second value if the number of interval outputs that are presence representations is less than the predetermined number; and an indication generator that receives the summary status and generates an indication if the summary status is the second value.

36. The sound variation indication apparatus of claim 35, further comprising a plurality of sound transducers that provide the respective audio signals to the plurality of comparison elements, based on respective received sound inputs.

37. The sound variation indication apparatus of claim 35, wherein the predetermined number is the same as the total number of interval outputs.

38. The sound variation indication apparatus of claim 37, wherein the summary status checker is a logic circuit that performs an AND operation on the interval outputs.

39. The sound variation indication apparatus of claim 37, wherein the summary status checker includes a logic circuit that performs an AND operation on the interval outputs to provide a summary representation, and a re-settable register that receives the summary representation and provides the corresponding summary status.

40. The sound variation indication apparatus of claim 39, wherein the re-settable register is a flip-flop circuit.

41. The sound variation indication apparatus of claim 39, wherein the summary status checker further includes a relay that actuates the indication generator if the summary status is the second value.

42. The sound variation indication apparatus of claim 37, wherein the summary status checker includes a logic circuit that performs an AND operation on the interval outputs to provide a summary representation, and a flip-flop circuit that receives the summary representation and processes the summary representation to provide the summary status.

43. The sound variation indication apparatus of claim 42, wherein the flip-flop circuit is re-settable.

44. The sound variation indication apparatus of claim 42, wherein the summary status checker further includes a relay that actuates the indication generator if the summary status is the second value.

45. A process of generating an indication on variation of a sound input, comprising:

providing an audio signal based on a received sound input;

comparing the audio signal to a check value;

providing a status signal based on an outcome of the comparison, wherein the status signal indicates a presence and absence of the sound input as corresponding to the check value, respectively indicating a presence value and an absence value;

determining a value of the status signal at predetermined intervals, to provide an interval output that is a presence representation if a presence value is determined during an interval and an absence representation if no presence value is determined during an interval; and generating an indication if the interval output is an absence representation.

46. The process of claim 45, wherein the sound input is received by and the audio signal is provided by a microphone.

47. The process of claim 46, further including at least partially isolating the microphone from ambient sound inputs to distinguish the received sound input.

48. The sound variation indication apparatus of claim 47, wherein at least partially isolating the sound transducer includes disposing an acoustic insulation material around at least a portion of the microphone.

49. The sound variation indication apparatus of claim 47, wherein at least partially isolating the sound transducer includes disposing an acoustic insulation structure around at least a portion of the microphone.

50. The process of claim 46, further including disposing the microphone proximate to a machine component to receive the sound input, wherein the machine component makes a repeated sound at regular intervals when functioning normally, and the microphone receives the repeated sound as the received sound input.

51. The process of claim 50, wherein the machine component is a cryocooler.

52. The process of claim 45, wherein providing an audio signal based on a received sound input includes receiving the sound input, providing a corresponding electrical signal, and conditioning the electrical signal to provide the audio signal.

53. The process of claim 52, wherein conditioning the electrical signal includes amplifying the electrical signal to provide the audio signal.

54. The process of claim 52, wherein conditioning the electrical signal includes buffering the electrical signal to provide the audio signal.

55. The process of claim 52, wherein conditioning the electrical signal includes filtering the electrical signal to provide the audio signal.

56. The process of claim 45, wherein comparing the audio signal to a check value includes providing the audio signal to a comparator circuit, which compares the audio signal to a voltage level corresponding to a level of the audio signal for an expected received sound input.

57. The process of claim 56, wherein the status signal is a binary signal indicating the presence and absence of the expected received sound input.

58. The process of claim 57, wherein determining a value of the status signal at predetermined intervals includes providing an interval output that is an absence representation if the status signal does not indicate the presence of the expected received sound input during the predetermined interval.

59. The process of claim 58, wherein determining a value of the status signal at predetermined intervals is performed by a retriggerable monostable multivibrator.

60. The process of claim 58, wherein the voltage level corresponds to an amplitude of the expected received sound input, the status signal is a pulse corresponding to occurrence of the received sound input, and the predetermined interval is based on a rate of recurrence of the expected received sound input.

61. The process of claim 58, wherein the voltage level corresponds to an amplitude of the expected received sound input, the status signal is a periodic pulse corresponding to the expected received sound input, which is an expected periodic sound input, and the predetermined interval is based on a frequency of the expected periodic sound input.

62. The process of claim 46, wherein generating an indication includes initiating a state change.

63. The process of claim 62, wherein the state change is a hardware state change.

64. The process of claim 62, wherein the state change is a software state change.

65. The process of claim 62, wherein initiating the state change includes generating an alarm.

66. The process of claim 65, wherein generating the alarm includes generating a sensory alarm.

67. The process of claim 65, wherein generating the alarm includes generating a non-sensory alarm.

68. The process of claim 67, wherein the non-sensory alarm is a software alarm.

69. The process of claim 45, wherein generating an indication includes generating an alarm.

70. The process of claim 69, wherein generating an alarm includes generating a sensory alarm.

71. The process of claim 69, wherein generating the alarm includes generating a non-sensory alarm.

72. The process of claim 71, wherein the non-sensory alarm is a software alarm.

73. The sound variation indication apparatus of claim 1, wherein the status signal is binary.

74. The sound variation indication apparatus of claim 1, wherein the indication generator provides the indication to a user.

75. The sound variation indication apparatus of claim 1, wherein the indication generator generates an indication only if the interval output is an absence representation.

76. The sound variation indication apparatus of claim 1, wherein the comparison element compares an analog audio signal to a fixed check value, and provides a digital status signal.

77. The sound variation indication apparatus of claim 76, wherein the fixed check value is adjustable.

78. The sound variation indication apparatus of claim 45, wherein the status signal is binary.

79. The sound variation indication apparatus of claim 45, wherein generating an indication includes providing the indication to a user.

80. The sound variation indication apparatus of claim 45, wherein the generating an indication if the interval output is an absence representation consists of generating an indication only if the interval output is an absence representation.

81. The sound variation indication apparatus of claim 45, wherein comparing an audio signal to a check value includes comparing an analog audio signal to a fixed check value, and providing a status signal includes providing a digital status signal.

82. The sound variation indication apparatus of claim 81, wherein the fixed check value is adjustable.

* * * * *